US005393244A

United States Patent [19]

Szegda

[11] Patent Number: 5,393,244

[45] Date of Patent: Feb. 28, 1995

[54] TWIST-ON COAXIAL CABLE END CONNECTOR WITH INTERNAL POST

[75] Inventor: Andrew Szegda, Canastota, N.Y.

[73] Assignee: John Mezzalingua Assoc. Inc., Manlius, N.Y.

[21] Appl. No.: 186,685

[22] Filed: Jan. 25, 1994

[51] Int. Cl.[6] ..... H01R 17/18; H01R 9/05

[52] U.S. Cl. ..... 439/394; 439/583

[58] Field of Search ..... 439/583, 584, 578, 393, 439/394

[56] References Cited

U.S. PATENT DOCUMENTS

| | | | |
|---|---|---|---|
| 3,601,766 | 8/1971 | Albert | 439/394 |
| 3,710,005 | 1/1973 | French | 439/583 X |
| 4,053,200 | 10/1977 | Pugner | 439/578 |
| 4,339,166 | 7/1982 | Dayton | 439/393 |
| 4,717,355 | 1/1988 | Mattis | 439/584 X |
| 5,002,503 | 3/1991 | Campbell et al. | 439/578 |
| 5,066,248 | 11/1991 | Gaver, Jr. et al. | 439/578 |
| 5,073,129 | 12/1991 | Szegda | 439/578 X |
| 5,195,905 | 3/1993 | Szegda | 439/394 |
| 5,195,906 | 3/1993 | Szegda | 439/394 |

*Primary Examiner*—P. Austin Bradley
*Assistant Examiner*—Jeanne M. Elpel
*Attorney, Agent, or Firm*—Samuels, Gauthier & Stevens

[57] ABSTRACT

An end connector for connecting a coaxial cable to a port having a tubular body with front and end portions a cable attachment section associated with the rear end portion for attaching the connector to the cable, and a port attachment section associated with the front end portion for attaching the connector to the port. The cable attachment section includes an interiorly threaded portion of the tubular body. An annular post is disposed in an intermediate region between the port attachment section and the cable attachment section, and extends partially into an is spaced radially from the interiorly threaded region. The annular post is adapted for insertion into the cable and at a position in which the annular post is in electrical contact with the outer conductor and electrically isolated from the inner conductor by the dielectric insulator, with a portion of the outer conductor overlying the jacket being driven into electrical contact with the interiorly threaded region. The annular post and an innermost portion of the interiorly threaded region define an indentation region adapted to receive a portion of the cable jacket so as to centrically support the cable within the tubular body.

5 Claims, 1 Drawing Sheet

TWIST-ON COAXIAL CABLE END CONNECTOR WITH INTERNAL POST

BACKGROUND OF THE INVENTION

The invention relates to end connectors used to connect cables to equipment ports, terminals, etc. The invention is particularly useful in, although not limited to, end connectors for coaxial cables in the cable television industry.

The conventional coaxial cable usually consists of a centrally located inner electrical conductor surrounded by and spaced inwardly from an outer electrical conductor. A dielectric insulator is interposed between the inner and outer conductors, with the outer conductor being surrounded by a protective dielectric jacket. The outer conductor includes a sheet of fine braided metallic strands, a metallic foil, or multiple layer combinations of either or both.

The conventional end connector is generally tubular in configuration, with a front end which is adapted to attached to equipment ports or terminals, and with a rear end adapted to receive and attach to the cable. An inner sleeve is designed to be inserted into a cable end in electrical contact with the outer conductor and electrically isolated from the inner conductor by the dielectric insulator. An outer sleeve is then crimped to securely couple the connector to the cable end and to achieve an electrical ground connection and weather seal. Examples of such end connectors are described in U.S. Pat. Nos. 4,990,106 and 5,073,129, of common assignee and incorporated herein by reference.

The above mentioned conventional end connectors are typically crimped to the cable with special tools and/or procedures, then threaded to a signal port. However, an average consumer will not invest in the proper crimping tools or procedures for the few connections required. In addition, the consumer usually will not thread the end connector completely onto the port, a task which requires five to six full turns for a complete and proper connection, thus creating a situation for possible signal loss.

In order to make the end connectors more user friendly F-connectors which are adapted to push on rather than thread on the signal ports, have been presented. These push-on type end connectors typically utilize a split ferrule configuration which includes a plurality of resilient finger that enable relatively easy connection and disconnection of the end connector to the signal port. Furthermore, end connectors have been developed for easy attachment to cables by utilizing an interiorly threaded portion so that the cable may be threaded into the end connector and provide an electrical connection to the outer conductive element of the cable. This so-called twist-on feature thus precludes the need for crimping or soldering of the end connector to the cable. An example of such an end connector is described in U.S. Pat. No. 5,195,906, of common assignee.

Certain disadvantages are also associated with end connectors that use the push-on and twist-on features. With respect to the twist-on attachment of the end connector to the cable, it may be difficult for the user to guide the prepared cable through the interiorly threaded portion so that the cable is properly centered within the tubular body of the end connector. Furthermore, the exposed metallic braid or foil of the prepared cable may not come into proper electrical contact with the interiorly threaded portion of the tubular body when threading the cable into the end connector.

The principle objective of the present invention is to provide an improved end connector designed to accommodate easy connection of the end connector to the prepared cable so that the cable is both properly supported within the end connector and proper electrical connections are made.

SUMMARY OF THE INVENTION

An end connector for connecting a coaxial cable to a port, the cable having an electrical inner conductor surrounded by and spaced inwardly from an electrical outer conductor, with a dielectric insulator interposed between the inner and outer conductors, and with a dielectric jacket surrounding the outer conductor. The end connector includes a tubular body having front and rear end portions, port attachment means associated with the front end portion for attaching the connector to the port, and cable attachment means associated with the rear end portion for attaching the connector to an end of the cable, the cable attachment means including an interiorly threaded region of the tubular body. An annular post is disposed in an intermediate region between the port attachment means and the cable attachment means, and extends partially into and is spaced radially from the interiorly threaded region. The annular post is adapted for insertion into the cable end at a position at which the annular post is in electrical contact with the outer conductor and electrically isolated from the inner conductor by the dielectric insulator, with a portion of the outer conductor overlying the jacket being driven into electrical contact with the interiorly threaded region.

According to one aspect of the present invention, an outer surface of the post is inwardly tapered as it extends from the intermediate region to the interiorly threaded region. Furthermore, an inner surface of the post is outwardly tapered as it extends from the intermediate region to the interiorly threaded region.

In another aspect of the present invention the annular post and an inner most portion of the interiorly threaded region define an indentation region adapted to receive a portion of the cable jacket so as to centrically support the cable within the tubular body.

DETAILED DESCRIPTION OF THE ILLUSTRATED EMBODIMENTS

Figure 1:
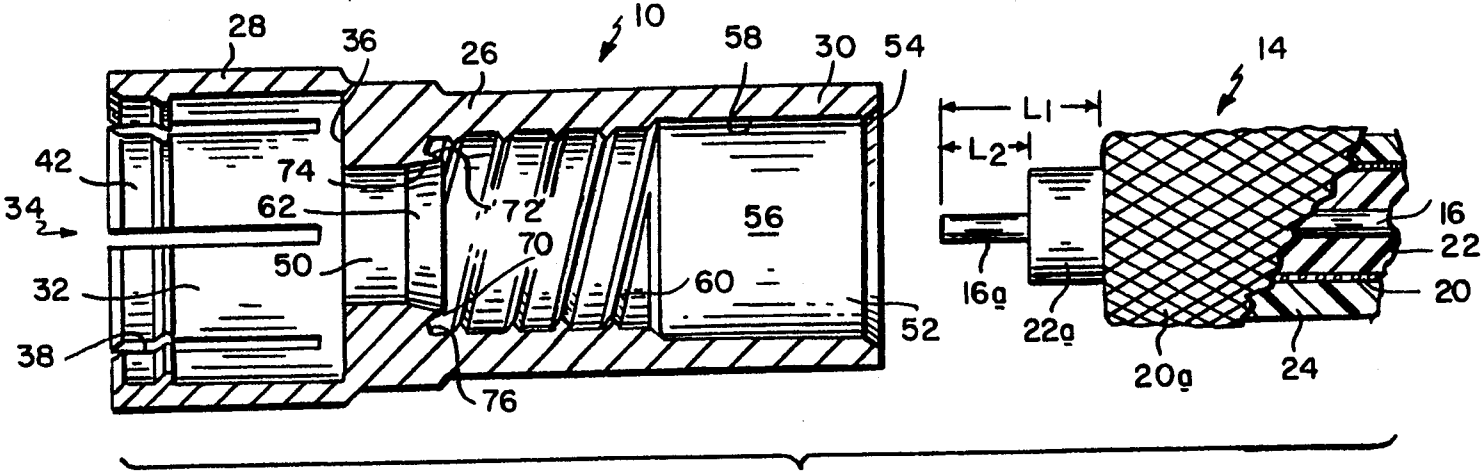
FIG. 1 is an enlarged sectional view of the end connector in accordance with the present invention and a prepared cable end.
Figure 2B:
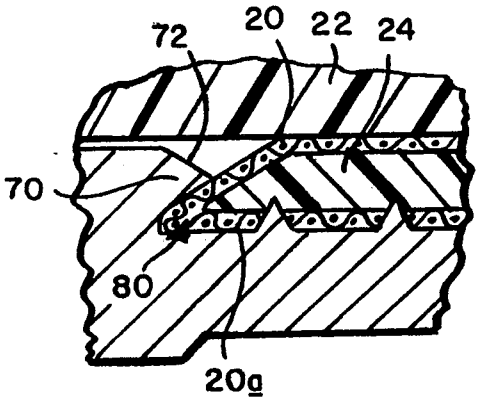
FIG. 2B is a blown up view of the internal post of the present invention as inserted into the cable end.
Figure 2A:
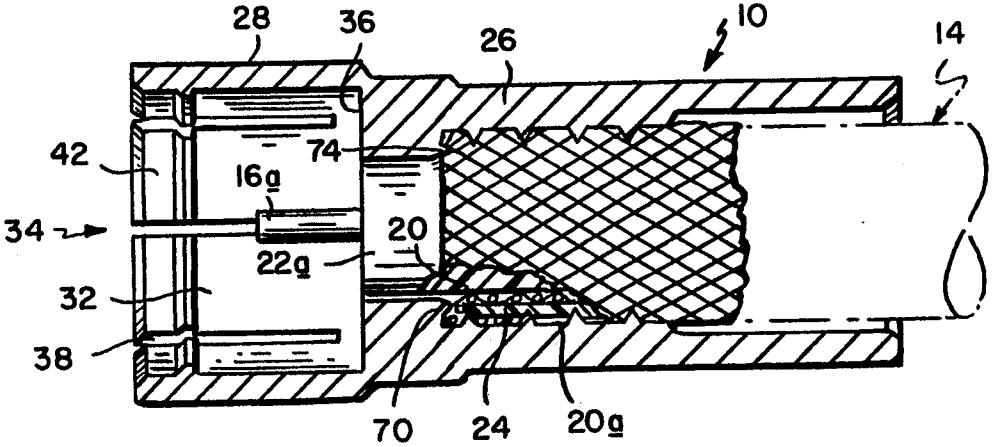
FIG. 2A is an enlarged sectional view of the end connector of FIG. 1 as it is attached to the prepared cable end.

With reference to FIGS. 1 and 2A, and end connector in accordance with the present invention is shown at 10 adjacent an end of a conventional coaxial cable 14 which has been prepared to receive the end connector.

In the example herein selected for illustrative purposes, the cable 14 includes an electrical inner conductor 16 surrounded by and spaced inwardly from an electrical outer conductor including a layer of braided metallic mesh 20. The inner and outer conductors are electrically isolated one from the other by a dielectric insulator 22 interposed therebetween. A dielectric protective covering or jacket 24 surround the outer conductor.

The end of the cable is prepared for coupling with the end connector by first removing length $L_1$ of the jacket 24 to thereby expose an end segment 20*a* of the braided metallic mesh. The exposed end segment of the mesh is then folded back over the jacket as illustrated in the drawings. Thereafter, a shorter length $L_2$ segment 22*a* of the exposed underlying dielectric insulator 22 is removed to thereby expose a segment 16*a* of the inner conductor.

The end connector 10 of the present invention includes a tubular body 26 having a front end portion 28 and a rear end portion 30. A split ferrule 32, which is adapted for attachment to a signal port, is provided at the front end portion 28 of the tubular body. The split ferrule comprises an open end 34 for receiving the signal port and a partially enclosed end 36. The split ferrule 32 also includes a number of longitudinal slits 38 which extend from the open end of the ferrule to a base end of the slit which is intermediate the open end and the partially enclosed end of the ferrule. The longitudinal slits define a plurality of partially cylindrical resilient fingers 42 which compensate for size tolerances of the signal port.

It will be appreciated that the front end portion 28 may be provided with a conventional coupling nut as utilized with crimping type end connectors.

The front end portion 28 also is provided with a through chamber 50 for communication with the rear end portion of the tubular body. The rear end portion includes a rear end opening 52 for receiving the prepared cable 14, and further defines a slightly tapered portion 54 which leads to an interior non-threaded chamber 56 which defines a smooth interior surface 58.

An interiorly threaded portion 60 is defined by the tubular body disposed between the non-threaded chamber 56 and the through chamber 50 leading to the front end portion 28 and ferrule 32.

The tapered portion 54 and the smooth interior surface 58 of the non-threaded chamber 56 serve initially to guide the prepared cable 14 for connection to the end connector. More importantly, the non-threaded chamber serves to cover the exposed metallic braided mesh of the prepared cable so that the user is not exposed to the fine sharp wire ends during the connection process. In addition, the metallic braided mesh may become lumped and thus impede entry of the cable into the threaded portion 60 and possibly cause damage to the cable. The interior surface 58 functions to smooth out the metallic braided mesh in order to prevent tearing of the same and to enhance the ease of connection to the cable.

In an intermediate region 62 between the through chamber 50 and the interiorly threaded portion 60, there is provided a post member 70 which extends from the through chamber 50 extending partially into and spaced radially from the interiorly threaded portion 60. The post member 70 includes an outer surface 72 which is inwardly tapered as it extends from the intermediate region 62 to the interiorly threaded portion 60, and an inner surface 74 which is outwardly tapered as it extends from the intermediate region to the interiorly threaded portion. An indentation region 76 is defined between the inner surface 72 of the post member 70 and an inner most portion of the interiorly threaded portion 60.

After the cable has entered the non-threaded chamber 56, the cable is threaded into the interiorly threaded portion 60. By twisting the cable into the threaded portion, the cable is drawn by the threaded action of the end connector as it creates a mating thread with the pliable material of the jacket 24. The thread crests are preferably sharp enough to penetrate into the surface of the cable jacket and yet not fracture it. The pliable material of the jacket flows into the threads to provide an axial holding force on the cable.

The end connector is threaded onto the cable until the exposed segment 16*a* of the inner conductor protrudes slightly beyond the open end 34 of the split ferrule 32, and the dielectric insulator segment 22*a* are received within the through chamber 50. At the same time, as can best be seen in FIG. 2B, the post member 70 is inserted into the cable end at a position in which the post member is in electrical contact with the metallic mesh layer 20 and electrically isolated from the inner conductor 16 by the dielectric insulator 22. The outer tapered surface 72 serves to drive a portion 80 of the jacket 24 with the folded over segment 20a of the mesh within the indentation region 76 so as to centrically support the cable within the end connector. Furthermore, the outwardly tapered surface 72 of the post member 70 serves to drive the portion 80, and thus the overlying mesh 20*a*, into electric contact with the interiorly threaded portion 60 of the tubular body as the cable is threaded into the end connector.

The foregoing description has been set forth to illustrate the invention and is not intended to be limiting. Since modifications of the described embodiments incorporating the spirit and substance of the invention may occur to persons of skill in art, the scope of the invention should be limited solely with reference to the appended claims and the equivalents thereof.

What is claimed is:

1. An end connector for connecting a prepared end of a coaxial cable to a port, said cable being of the type having an electrical inner conductor surrounded by and spaced radially inwardly from an electrical outer conductor by a dielectric insulator interposed therebetween, with a dielectric jacket surrounding said outer conductor, the prepared end of said cable having an exposed portion of said inner conductor protruding beyond an exposed portion of said dielectric insulator which in turn protrudes beyond an exposed portion of said outer conductor, the exposed portion of said outer conductor having been peeled back to surround an end portion of said dielectric jacket, said end connector comprising:

a tubular body having cylindrical front and rear wall portions joined by an intermediate wall portion, said front and rear wall portions respectively defining front and rear chambers leading respectively from open front and rear ends of said body to front and rear ends of a reduced diameter bore extending through said intermediate wall portion, the rear end of said bore being surrounded by a shoulder having an edge spaced radially inwardly from said rear wall portion and protruding axially into said rear chamber, said shoulder having an outer surface which is inwardly tapered and an inner surface which is outwardly tapered as the shoulder extends from said rear wall portion to said rear chamber, said open front end being configured and dimensioned to axially receive a port into an inserted position in said front chamber, and said open rear end being configured and dimensioned to axially receive the prepared end of a coaxial cable into an inserted position at which the exposed portions of said inner conductor, dielectric insulator and outer conductor are loaded respectively in said front chamber, intermediate bore, and rear chamber;

first attachment means associated with said front wall portion for securing said connector to the thus received port; and second attachment means associated with said rear wall portion for securing said connector to the thus received prepared end of said cable, said second attachment means including an interiorly threaded segment of said rear wall portion which coacts in threaded engagement with the exposed portion of said outer conductor to urge said cable towards the front end of said connector, thereby causing the edge of said shoulder to penetrate said cable with a resulting radial expansion of the exposed portion of said outer conductor outwardly against the rear wall portion of said conductor.

2. An end connector for connecting a coaxial cable to a port, said cable having an electrical inner conductor surrounded by and spaced inwardly from an electrical outer conductor, with a dielectric insulator interposed between said inner and outer conductors, and with a dielectric jacket surrounding said outer conductor, said cable including a prepared end at which a portion of said outer conductor is folded back to overlie an outer portion of said jacket, said end connector comprising:

a tubular body having a front end portion and a rear end portion;

port attachment means associated with said front end portion for attaching said connector to said port;

cable attachment means associated with said rear end portion for attaching said connector to the prepared end of said cable, said cable attachment means including an interiorly threaded region of said tubular body; and an annular post disposed in an intermediate region between said port attachment means and said cable attachment means, and extending partially into and spaced radially from said interiorly threaded region, said annular post having an outer surface which is inwardly tapered and an inner surface which is outwardly tapered as the post extends from said intermediate region to said interiorly threaded region, said annular post being adapted for insertion into the prepared end of said cable at a position at which said annular post is in electrical contact with said outer conductor and electrically isolated from said inner conductor by said dielectric insulator, with the portion of said outer conductor overlying said jacket being driven into contact with said interiorly threaded region.

3. The end connector of claim 2, wherein said annular post and an innermost portion of said interiorly threaded region define an indentation region adapted to receive a portion of said cable jacket so as to centrically support said cable within said tubular body.

4. The end connector of claim 2 further comprising a nonthreaded interior chamber region of said tubular body which precedes said interiorly threaded region at said rear end portion.

5. The end connector of claim 2, wherein said port attachment means comprises a split ferrule.

* * * * *